United States Patent [19]

Pietzka et al.

[11] 4,137,150

[45] Jan. 30, 1979

[54] METHOD FOR THE MANUFACTURE OF A COAL-TAR PITCH COKE

[75] Inventors: Gerhard Pietzka, Vockenhausen, Taunus; Harald Tillmanns, Kelkheim, both of Germany

[73] Assignee: Sigri Elektrographit GmbH, Meitingen bei Augsburg, Germany

[21] Appl. No.: 817,238

[22] Filed: Jul. 20, 1977

[30] Foreign Application Priority Data

Aug. 6, 1976 [DE] Fed. Rep. of Germany ..... 2635451

[51] Int. Cl.$^2$ ..... C10B 55/00; C01B 31/02

[52] U.S. Cl. ..... 208/106; 208/131; 423/448; 423/449

[58] Field of Search ..... 423/445, 448, 449; 208/22, 23, 39, 44, 50, 85, 106, 131

[56] References Cited

U.S. PATENT DOCUMENTS

| | | | |
|---|---|---|---|
| 3,035,308 | 5/1962 | Bagoss et al. | 423/448 |
| 3,112,181 | 11/1963 | Petersen et al. | 423/448 |
| 3,460,907 | 8/1969 | Winsett | 423/448 |
| 3,799,865 | 3/1974 | Suetsugu et al. | 208/131 |
| 3,839,515 | 10/1974 | Bomovacek | 423/449 |
| 3,960,704 | 1/1976 | Kegler et al. | 423/445 X |

*Primary Examiner*—Edward J. Meros

*Attorney, Agent, or Firm*—Herbert L. Lerner

[57] ABSTRACT

Manufacture of coal-tar pitch coke with a predetermined degree of anisotropy of the linear thermal expansion coefficients and thermal volume expansion coefficient by adding primary resin and secondary resin to produce a pitch mixture having primary resin content and secondary resin content to cause on coking of the mixture production of coke having the desired properties of degree of anisotropy and thermal volume expansion coefficient. By the addition of the resins, production of a coal-tar pitch coke with a volume expansion coefficient between approximately $3 \times 10^{-6}$ and $18 \times 10^{-6}$ an anisotropy degree of approximately 1.1 to 2.0 may be obtained.

3 Claims, 2 Drawing Figures

METHOD FOR THE MANUFACTURE OF A COAL-TAR PITCH COKE

BACKGROUND OF THE INVENTION

1. Field of the Invention

This invention relates to coke and more particularly refers to a new and improved method for the manufacture of coal-tar pitch with a predetermined degree of anisotropy and coefficient of volume expansion.

2. Description of the Prior Art

From German Published Prosecuted application 1 189 517 it was known to manufacture coal-tar pitch coke with a low thermal coefficient of expansion and needle-like texture from coal tar pitches called tars from which "soot-like" substances have been separated. By the term "soot-like" substances are meant substances insoluble in quinoline which in addition to soot and minerals are high-molecular, resinous compounds, mostly aromatic in nature. These substances, which are insoluble in quinoline are separated by separators, centrifuges or filters from tar which has been treated with suitable solvents as for example tar oils, and heated above the temperature of the softening point. The tar which has been freed from soot, minerals and high-molecular aromatic compounds, is pyrolized in ovens such as are usually used for producing normal coal-tar pitch coke, by special multi-step carbonizing processes or by a delayed coking process to produce a coal-tar pitch coke with a thermal volume expansion coefficient of less than $6 \times 10^{-6}$/K.

Vectorial properties of these cokes, such as the linear thermal expansion coefficient, electrical resistance, strength, and others are to a great extent dependent on the spatial direction in which they are observed. This dependence of direction, called anisotropy, is usually numerically defined as anisotropy-ratio or degree of anisotropy and, for example, the degree of anisotropy of the linear thermal expansion coefficients is approximately 1.6 to 2.0. Graphite bodies made from these cokes also show a relatively low volume expansion coefficients and a high degree of anisotropy. Because of their low electrical resistance in the axial direction and their outstanding stability against rapid temperature changes, these graphite bodies are particularly well suited for the production of electro-steel. Graphites made from cokes with a high degree of anisotropy are less suitable for a number of other uses, for example structural parts or parts for moderators for high temperature reactors, since the changes in length caused by the neutron radiation are also a function of the spatial direction, causing the original shape of the bodies to change during radiation or the accumulation of stresses from such radiation can lead to the formation of cracks in the graphite. Cokes with a low degree of anisotropy (isotropic or quasi-isotropic cokes) are preferred for this type of application.

Several methods have become known for the production of an isotropic coke by the pyrolization of coal-tar pitch or derivatives of tars. For example in the method according to the German Published Non-Prosecuted application 2 300 023, the tar distillate in the temperature range of 250 to 420° C., before pyrolization, treated, i.e. blown with a gas mixture containing elementary oxygen. The coal-tar pitch cokes that result from a process of this type are nearly isotropic — the degree of anisotropy of the linear expansion coefficient is 1.2 or less — and are suitable for the manufacture of graphite for high-temperature reactors. These cokes, however, show a thermal volume expansion coefficient larger than about $15 \times 10^{-6}$/K and therefore are not suitable as starting material for production of graphite bodies which are, for example, subject to higher temperature requirements.

SUMMARY OF THE INVENTION

An object of the present invention is to provide a method of converting coal-tar pitch to produce a wide range of cokes with each coke thus produced having a predetermined degree of anisotropy of the linear thermal expansion coefficients and thermal volume expansion coefficient.

Another object of the invention is to provide a coal-tar pitch coke with a low thermal volume expansion coefficient and a low degree of anisotropy of the linear thermal expansion coefficients.

With the foregoing and other objects in view, there is provided in accordance with the invention a method for the manufacture of coal-tar pitch coke from coal-tar pitch by heating the pitch to a temperature up to about 1300° C. to convert the pitch to coke, with a predetermined degree of anisotropy and thermal volume expansion coefficient, by adjusting primary resin content and secondary resin content in the pitch to produce a coke having desired degree of anisotropy of the linear thermal expansion coefficients and thermal volume expansion coefficient.

There is provided in accordance with the invention coal-tar pitch coke, characterized by a thermal volume expansion coefficient of less than $5 \times 10^{-6}$/K and a degree of anisotropy of the linear thermal expansion coefficients of less than 1.3.

Other features which are considered as characteristic for the invention are set forth in the appended claims.

Although the invention is illustrated and described herein as embodied in a method for the manufacture of a coal-tar pitch coke, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

In the known method for production of coal-tar pitch coke, a fixed relationship between the degree of anisotropy and the thermal expansion coefficient exists. The method in accordance with the invention makes it possible to produce a wide range of pitch cokes with different predetermined ratios of anisotropy degree and thermal volume expansion coefficient so that in each case the coke will have the best ratio for its intended application. In particular, one of the objects of the invention is to produce a coal tar pitch coke with a low volume expansion coefficient and a low degree of anisotropy. Coal-tar pitch coke of the desired characteristics are produced by adding to the coal tar pitch, before pyrolization, primary and/or secondary α-resins in such quantities as are required to achieve the predetermined properties of the cokes.

By the term resins, are meant those components of a coal-tar pitch which are insoluble in quinoline, which — as mentioned — are obviously a mixture of various substances. The part designated as primary α-resin consists mainly of mineral substances and solid reaction products that are formed during the coal-distillation by gas phase pyrolysis. The secondary α-resins which are present only in small amounts in prime tars and prime pitches, form during the slow heating of tars in the temperature range between about 350° and 500° C. Primary and secondary α-resins are distinguished microscopically by their different morphology or chemically by the different hydrogen content, which for primary α-resins is $< 2\%$ and for secondary α-resins is $> 3\%$.

The two parts of α-resins influence the properties of pitch cokes in different ways. The degree of anisotropy and the thermal volume expansion coefficient of a coal-tar pitch coke can be determined to a great extent by blending the tars which are the starting material with primary and/or secondary α-resins, whereby the individual parameters are controlled by the total portion and the ratio of the two resin portions to each other. This control of the individual parameters will be illustrated in the diagrams of FIGS. 1 and 2.

Figure 1:
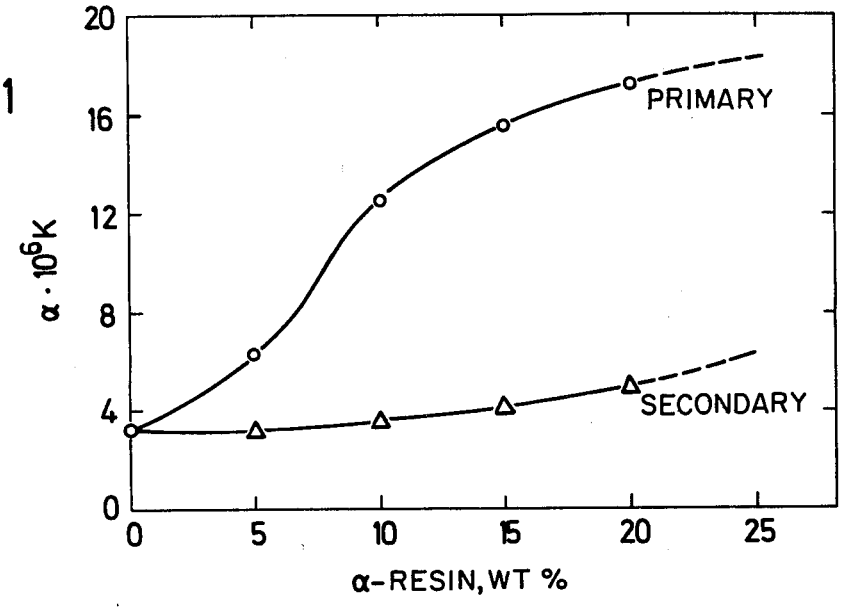
FIG. 1 is a graph of the thermal volume expansion coefficient as a function of the $\alpha$-resin content.

Referring to FIG. 1, the volume expansion coefficient of a coal-tar pitch coke which is free of α-resins is $3 \times 10^{-6}$/K. Additions of primary α-resin effect a considerable increase of the volume expansion coefficient; additions of secondary α-resin raise the volume expansion coefficient only negligibly. The range between the two lines of the graph may be covered by additions of mixtures of primary and secondary α-resins.

Figure 2:
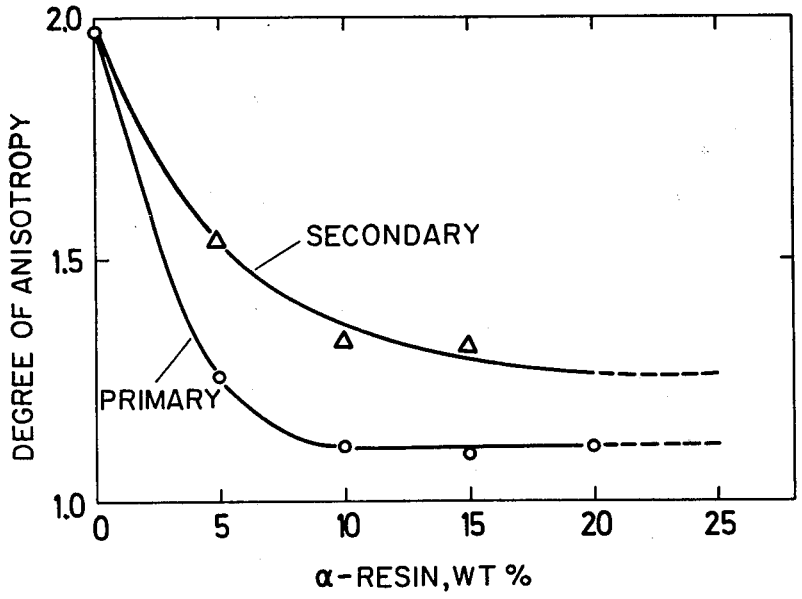
FIG. 2 is a graph of the anisotropy degree as a function of the $\alpha$-resin content.

Referring to FIG. 2, the degree of the linear thermal expansion coefficients of coal-tar pitch coke decreases proportionally to the amount of α-resins added to the starting material. The degree of anisotropy of a coke that is manufactured free of α-resin is almost 2.0. By addition of 10% primary α-resins, the degree anisotropy is reduced to approximately 1.1; by the addition of 10% secondary α-resin to barely 1.4. Values for anisotropy between the two graph lines can be achieved by mixtures of the two α-resin portions. In accordance with the invention a coal-tar pitch coke may be produced with a volume expansion coefficient between about $3 \times 10^{-6}$ and $18 \times 10^{-6}$/K and a degree of anisotropy of approximately 1.1 to 2.0.

Thus in each case a coke can be selected which gives the graphite best suited for a particular application. For example, for the starting coke for the production of reactor graphite, a coke with a low degree of anisotropy — approximately less than 1.2 — will be chosen. For this coke, the thermal expansion coefficient can be freely varied in a range of about 4 to $18 \times 10^{-6}$/K. For the manufacture of highly stressed graphite electrodes, a coke with a thermal volume expansion coefficient of $< 4 \times 10^{-6}$/K and whose degree of anisotropy is variable, in a range of 1.2 to 2.0, is preferable, because of its better graphitization properties. In general, the invention makes it possible to predetermine with great reliability over a wide range the properties of coal-tar pitch coke and thereby, the properties of graphites manufactured from these cokes, and to adapt them to the respective application to a degree not achieved up to the present time. The invention is capable of producing a nearly isotropic coke with a thermal volume expansion coefficient of $< 5 \times 10^{-6}$/K.

The primary and secondary α-resins which are used as control agents for the properties of the coal-tar pitch coke are, in practice, separated from coal tars in separators, centrifuges or filters, in some cases after addition of a solvent. The resins may be separated by extraction, for example, with quinoline or anthracene oil as extraction agents. The resins are added to a tar that does not contain α-resins or contains a known amount of the latter, in a known distribution. The resins are either added to a solid tar in very finely ground solid state or stirred into tar melts. No detrimental dissociations have been observed with this method. Coal pitch tars that have not undergone an after-treatment or have not been blasted, i.e. blown with a gaseous agent are suitable as a source for the primary α-resins. The hydrogen content of the resin extract is approximately 1.2 to 1.5%. Secondary α-resins are obtained by the thermal treatment of a pitch in a temperature range of about 350° to 500° C. The treatment time is about 2 to 10 hours with time of treatment decreasing with increasing temperature. The secondary α-resins, whose hydrogen content is approximately 3.3 to 3.6 are separated in a manner similar to the separation of the primary α-resins, for example, by filtration or extraction. Conventional carbonization methods such as are in use for the production of coal-tar pitch coke or methods for delayed coking with calcination at a temperature up to about 1300° C. may be used for the pyrolysis of the pitches which have been blended with the α-resins.

Since most coal-tar pitches which are usable for the manufacture of cokes contain a considerable portion of α-resins, if the resin content and distribution is known, it is generally not necessary to completely separate the resins, but only to add to the pitch containing some resin, the required amount of primary and secondary resins to obtain the desired effect. The actual resin content in the pitch may be readily ascertained by extraction of the tar with quinoline and determining the hydrogen content of the parts of the resin which are insoluble in quinoline.

The following example illustrates the present invention:

For the manufacture of a coke which graphitizes well with a low degree of anisotropy, a coal tar pitch with a softening point of 150° C., determined by the method of Kraemer-Sarnow, was heated to approximately 280° C. and after addition of 0.5% Kieselgur as filtration aid, was filtrated under a pressure of 2 to 8 bar. To the filtrate, which still contained approximately 0.2% α-resins, 6 weight % of secondary and 4 weight % of primary α-resins were stirred in.

The blended pitch was heated for carbonization with a gradient of approximately 150° C./h to 380° C., and with a gradient of 5° C./h from 380° to 480° C. The coke was subsequently calcinated by further heating to 1300° C. The calcinated coke had a density (bulk density) of 2.12g/cm$^3$. The microscopic structure was small to medium grained and isotropic. The thermal volume expansion coefficient and the degree of anisotropy of the linear coefficients of expansion were measured on cubes of coke between 20° and 200° C.

$^*\alpha_v - 4.5 \times 10^{-6}$/K

Anisotropy degree — 1.25

$^*(\alpha_{max}/\alpha_{min})$ 100 parts of ground coke with approximately 30% of the finest grain portion < 0.1 mm, were mixed with 25 parts of coal-tar pitch as a binder and the mixture was formed by extrusion to cylindrical bodies of approximately 100 mm diameter. Subsequently, the cylinders were heated to ca. 1000° C. in a ring-chamber furnace for carbonization of the binder-agent and heated to ca. 2800° C. in an Acheson furnace for conversion to graphite. Inspite of a low degree of anisotropy of 1.2, the graphite bodies which proved unusually stable against rapid temperature changes, showed a volume expansion coefficient of only $7 \times 10^{-6}$/K.

There are claimed:

1. In a method for the manufacture of coal-tar pitch coke from coal-tar pitch by heating the pitch to a temperature up to about 1300° C. to convert the pitch to coke, the improvement comprising producing coke with a predetermined degree of anisotropy and thermal volume expansion coefficient by adjusting primary resin content which are components of a coal-tar pitch which are insoluble in quinoline and have a hydrogen content which is < 2%, and secondary resin content which are components of a coal-tar pitch which are insoluble in quinoline and have a hydrogen content which is > 3%, in the pitch to produce a coke having desired degree of anisotropy of the linear thermal expansion coefficients and thermal volume expansion coefficient, wherein the pitch prior to coking is subjected to a separation treatment to remove solid particles therefrom and primary resin and secondary resins are added to the pitch after separation treatment to effect said adjusting of primary resin content and secondary resin content in the pitch.

2. A process as claimed in claim 1, wherein said separation is filtration of the pitch at a temperature at least 100° C. above its softening point.

3. Method according to claim 1, wherein said primary resin content and said secondary resin content in the pitch are in an amount of up to about 20% each by weight of the pitch.

* * * * *